United States Patent [19]

Kimball

[11] 4,289,150

[45] Sep. 15, 1981

[54] PROTECTIVE COVER AND METHOD FOR TREATING HAIR

[76] Inventor: David D. Kimball, 4677 Wallace La., Salt Lake City, Utah 84117

[21] Appl. No.: 40,798

[22] Filed: May 21, 1979

[51] Int. Cl.[3] ..... A45D 7/00

[52] U.S. Cl. ..... 132/7; 132/9

[58] Field of Search ..... 132/9, 7; 428/304, 310, 428/906

[56] References Cited

U.S. PATENT DOCUMENTS

| | | | |
|---|---|---|---|
| 2,780,352 | 2/1957 | Schroeder | 428/906 |
| 2,781,764 | 2/1957 | Miller | 132/9 |
| 2,818,074 | 12/1957 | Mach | 132/9 |
| 2,857,917 | 10/1958 | Cortez | 132/9 |
| 2,957,480 | 10/1960 | Widoff | 132/7 |
| 3,240,855 | 3/1966 | Voelker | 428/906 |
| 3,249,113 | 11/1963 | Sobeck | 132/9 |
| 3,270,753 | 9/1966 | Cook | 132/9 |
| 3,302,653 | 2/1967 | D'Agostino | 132/9 |
| 3,390,689 | 7/1968 | Newman | 132/9 |
| 3,390,689 | 7/1968 | Newman | 132/9 |
| 3,425,889 | 2/1969 | Willits, Jr. | 428/906 |
| 3,543,770 | 12/1970 | Snider | 132/7 |
| 3,586,009 | 6/1971 | Sirmms | 132/9 |
| 4,020,854 | 5/1977 | Caruso | 132/9 |
| 4,061,808 | 12/1977 | Sato | 428/906 |

*Primary Examiner*—Theodore A. Granger

*Attorney, Agent, or Firm*—Mallinckrodt & Mallinckrodt

[57] ABSTRACT

A method and apparatus for a completely disposable, one-time use protective cover that may be used for dyeing selected locks of hair. The protective cover includes a sheet of synthetic sponge-like material having a liquid-impervious liner. The liquid-impervious liner may be a sheet of thin plastic material attached or bonded to one face of the synthetic sponge-like material. The protective cover is easily punctured by a hook used to withdraw locks of hair through the points of puncture. The protective cover may be provided in a continuous roll with perforations at predetermined locations along the length of the roll so that individual protective covers may be separated from the roll and folded so as to conform to the scalp of a patron undergoing hair treatment. In another embodiment, the protective cover is formed in a shell-like configuration that fits loosely over the patron's head. A skirt is provided and may be folded over the treated hair as part of the treatment process.

17 Claims, 14 Drawing Figures

PROTECTIVE COVER AND METHOD FOR TREATING HAIR

BACKGROUND

1. Field of the Invention

This invention relates to an apparatus and method for treating hair and, more particularly, to a method and apparatus for a completely disposable, one-time use protective cover that may be used for dyeing selected locks of hair.

2. The Prior Art

Professional hairdressers have used various techniques for imparting a variegated appearance to hair. Typically, a variegated appearance is obtained by coloring or bleaching only preselected locks of hair. These treatment techniques are known in the art as "bleaching," "frosting," "streaking," or "tipping." Other variegated effects are referred to in the art as "accenting," "flashing," "glazing," "haloing," "highlighting," "marbleizing," "naturalizing," "rainbowing," etc.

While the basic procedures are fairly similar in practically all of the above instances, the particular types of apparatus used have varied widely. Examples of the wide variety of available hair coloring methods and apparatus may be found in the following U.S. Pat. Nos. 2,781,764; 2,818,074; 2,857,917; 2,957,480; 3,249,113; 3,302,653; 3,390,689; 3,270,753; 3,543,770; 3,586,009; and 4,020,854.

While various prior art devices are known and used, they each have undesirable limitations or drawbacks. For example, most protective caps currently used for hair coloring treatment are fabricated so as to be reusable. Reusable protective caps are usually made from a heavy elastomeric material and are generally provided in a limited size range. Typically, they are either too tight or too loose on the wearer. Additionally, many reusable protective caps become stained, developing an unpleasant appearance and an offensive smell. Moreover, perforations at predetermined locations in the caps limit the hairdresser from being able to fully utilize his or her artistic skills in selecting the strands of hair to be given the appropriate treatment.

One further serious drawback to the known prior art devices is the fluid-impervious outer covering of the protective caps that causes spilled hair treatment liquids to drain onto the skin of the wearer. While many devices include gutter-type arrangements around the outer periphery, it is well-known that spilled treatment liquid collects in the gutters and frequently drips onto the patron during treatment.

In view of the foregoing, it would be a significant advancement in the art to provide an inexpensive, one-time use protective cap for use in hair coloring processes. To avoid the disadvantages noted above, the disposable protective cap should be able to absorb excess liquid dye that may be applied to selected locks of hair. The protective cap should also provide a liquid-impervious barrier for shielding the undyed portions of hair. It would be a further improvement in the art to provide a protective cap that may be adjusted to comfortably fit the scalp of a patron and that will permit any desired portion of the hair to be exposed for coloring treatment.

BRIEF SUMMARY AND OBJECTS OF THE INVENTION

The present invention provides a novel method and protective covering for use in hair coloring treatments. The protective cover may be preformed into a cap having a shell-like configuration or it may be provided as a generally flat sheet dispensed from a roll and folded to comfortably fit a particular patron. The protective cover consists of a sheet of synthetic sponge-like material adapted to absorb any excess liquid dye. A liquid-impervious liner is attached to one side of the sponge material. The liner shields the remaining portions of hair from coming into contact with the liquid dye applied to selected locks of hair. The protective cover may be easily punctured by a hook so that locks of hair may be withdrawn for hair coloring treatment at any location. The protective cover of the present invention is inexpensive to manufacture and may thus be disposed after a single use.

It is, therefore, a primary object of the present invention to provide an improved method and protective cover for treating hair.

Another object of this invention is to provide an improved protective cover fabricated from an outer, synthetic sponge-like material that is liquid absorbent and an inner, liquid-impervious liner.

Another object of the present invention is to provide a protective cover that can easily be adjusted to fit a patron's head.

Another object of the present invention is to provide an improved hair treatment protective cover configurated as a cap-like member fabricated from a synthetic sponge material and having a liquid-impervious liner, the liner extending beyond the periphery of the cap so that it may be drawn upwardly to enclose the treated hair.

Another object of this invention is to provide an inexpensive protective cover that may be disposed after a single use.

Yet a further object of the present invention is to provide a protective cover that may be easily punctured at any location to permit a lock of hair to be withdrawn for purposes of coloring treatment.

These and other objects and features of the present invention will become more fully apparent from the following description and appended claims taken in conjunction with the accompanying drawing.

DETAILED DESCRIPTION OF THE PREFERRED EMBODIMENTS

Figure 1:
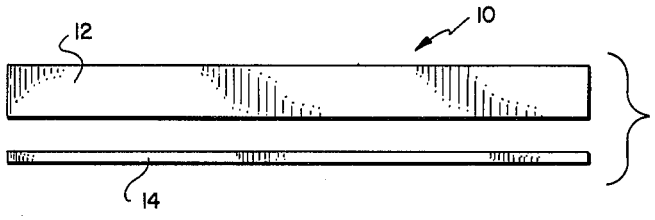
FIG. 1 is an exploded, side elevation of a first preferred embodiment of the protective material of this invention shown greatly enlarged for ease of illustration, the protective material including an upper, synthetic sponge-like material and a liquid-impervious liner.

The invention is best understood by reference to the drawing wherein like parts are designated with like numerals throughout.

Figure 2:
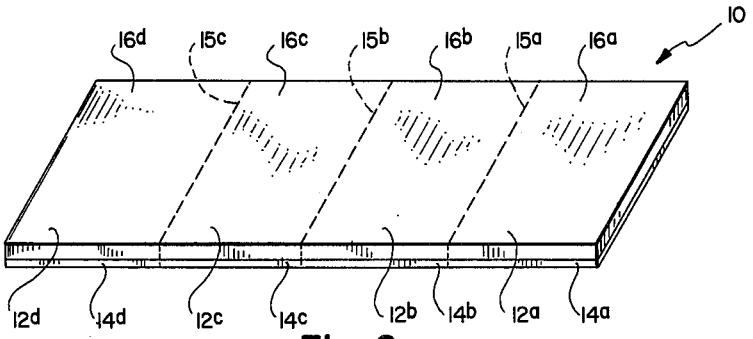
FIG. 2 is a perspective view of a plurality of joined segments of synthetic sponge-like material having a liquid-impervious liner as in FIG. 1, also shown with exaggerated thicknesses for ease of illustration.

Referring now more particularly to FIGS. 1 and 2, the protective cover material of this invention is shown generally at 10 and includes an outer layer of synthetic sponge-like material 12 having a liquid-impervious liner 14 secured thereto. Both synthetic sponge layer 12 and liquid-impervious liner 14 are shown greatly exaggerated in thickness for ease of illustration. Importantly, sponge material 10 and liner 14 are suitably pliable to allow the protective cover 10 to be folded to fit the scalp of the person undergoing hair treatment. Synthetic sponge material 12 is typically about ⅛ inch thick while the liquid-impervious liner is less than about 1 or 2 mils in thickness.

Referring now more particularly to FIG. 2, the protective cover material of this invention is shown generally at 10 as an elongated, continuous length provided with perforations (shown by broken lines 15*a*–15*c*). The perforations 15 provide a plurality of protective covers 16*a*–16*d*, respectively, as will be shown more fully hereinafter.

Figure 3:
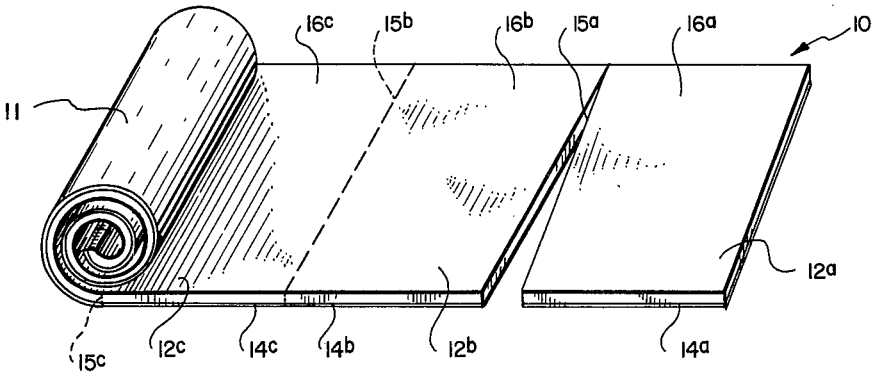
FIG. 3 is a perspective view of the protective material of FIG. 2 shown rolled up and also having perforations therein to accomodate separation of segments.

Referring now to FIG. 3, the continuous length of protective cover material 10 has been rolled into a roll 11 to provide a bulk supply of protective covers 16*a*–16*c*. While roll 11 is shown as loosely rolled for ease of illustration, in practice, roll 11 is generally tightly rolled. In the illustrated embodiment of FIG. 3, protective cover 16*a* is shown as being partially separated from the roll 10 by tearing the perforations along line 15*a*. Roll 11 thus provides a convenient supply of protective covers 16*a*–16*c* for single-use application and subsequent disposal.

Figure 4:
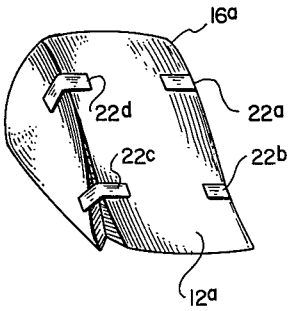
FIG. 4 is a perspective view of one preferred embodiment of the protective material of this invention shown folded in a cap-like configuration and held with tabs.

With reference to FIG. 4, the protective cover 16*a* is shown in a folded configuration. Tabs 22*a*–22*d* are used to secure the various folds of protective cover 16*a* once it has been placed on a patron's head and folded to achieve the desired fit. Tabs 22*a*–22*d* may be of any suitable type, including adhesive tabs or the "hook" and "eye" type tabs marketed under the tradename "Velcro".

The protective cover of this invention is especially useful since it can be folded, cut, trimmed, etc., to allow the hairdresser to comfortably conform the protective cover to fit the scalp of any patron. As described in more detail below, the protective cover of this invention may also be preformed to provide a shell-like cap that is adjustable to fit each patron. In either circumstance, the protective cover is oriented so that the sponge-like layer 12 is the outer surface and the liquid-impervious liner 14 is placed next to the patron's scalp.

Figure 5:
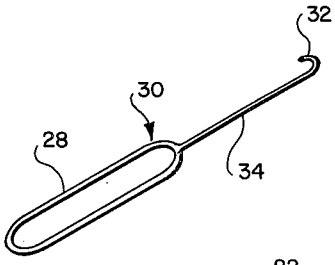
FIG. 5 is a perspective view of a hook-like device for puncturing the protective covering and drawing locks of hair therethrough.

Referring now more particularly to FIG. 5, a tool 30 is shown. Tool 30 includes a handle 28 with a shank 34 extending therefrom and terminating in a hook 32. Tool 30 is used for withdrawing locks of hair 24 (see FIGS. 6 and 7) through the protective cover. Hook 32 is used to puncture synthetic sponge material 12 and liquid-impervious liner 14. Hook 32 is then used to engage and withdraw a lock of hair 24 through the point of puncture 25 (see FIG. 6) made through the protective cover 16*a*. The curvature of hook 32 is sufficiently smooth to guard against injury to the scalp of the person undergoing hair treatment.

Figure 6:
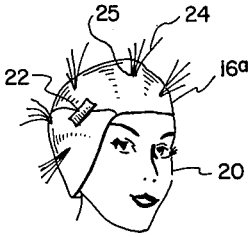
FIG. 6 is a schematic illustration of a protective cover folded to fit the scalp of a patron, and illustrating locks of hair pulled through the protective cover at predetermined points of puncture.
Figure 7:
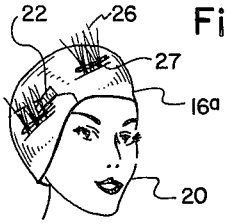
FIG. 7 is a schematic view of a protective cover shown on the scalp of a person undergoing treatment and shown with locks of hair drawn through slits made at predetermined locations.

With further reference to FIGS. 6 and 7, it will be seen that locks of hair 24 may be pulled through the protective cover 16*a* at any desired location. This greatly enhances the flexibility of hair coloring patterns that may be achieved. For example, as shown in FIG. 7, the protective cover 16*a* has been punctured along a slot 27 to permit the hairdresser (not shown) to withdraw large locks of hair 26. Slots 27, like the individual points of puncture 25 (FIG. 6), may be placed at any location in the protective cover 16*a*.

Advantageously, the protective cover of this invention is very soft, flexible, and comfortable to the person upon whose scalp the protective cover is placed. Additionally, the resilience of synthetic sponge-like material 12 tends to seal the resultant opening about the locks of hair 24 so as to protect the remaining hair from coming into contact with any liquid dye applied to the locks of hair 24. Liner 14 further shields the remaining portion of hair from contact with the liquid dye. Moreover, another primary advantage of synthetic sponge-like material 12 is to provide an absorbant surface to absorb and capture any spillages of hair treatment liquid.

Figure 8:
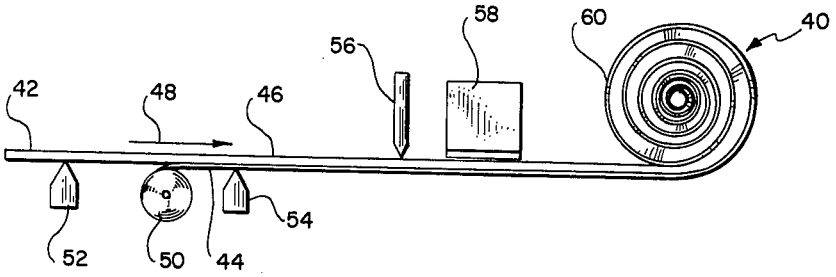
FIG. 8 is a schematic view of one presently preferred embodiment of a method of preparing the protective cover of this invention.

Referring now more particularly to FIG. 8, a process for preparing a continuous roll of the protective cover material 46 of this invention is shown generally at 40. The process includes preparing a layer of synthetic sponge-like material 42 and placing a liquid-impervious underlayment 44 thereon. For example, a layer of synthetic sponge-like material 42 can be drawn, in the direction indicated by arrow 48, across an applicator shown schematically at 52. Applicator 52 may be used for applying an adhesive surface to the lower face of synthetic sponge-like material 42. The adhesive surface serves to suitably bond the liquid-impervious underlayment 44 to the sponge-like material 42. Underlayment 44 may be a sheet of thin plastic material provided from a roll 50. Alternatively, a bonding apparatus shown schematically at 54 can assist in bonding liquid-impervious underlayment 44 to synthetic sponge material 42. Bonding apparatus 54 may be any suitable device, including, a heat sealing device, an ultrasonic welder, or the like.

While applicator 52 is shown as an adhesive applicator, applicator 52 could also be in the form of a doctor knife or the like for the purpose of directly applying a liquid-impervious layer to the surface of synthetic sponge material 42. Correspondingly, apparatus 54 could also be a doctor knife, heat sealing means or the like.

After liquid-impervious underlayment 44 has been imparted to synthetic sponge-like material 42, the protective cover material 46 of this invention may be suitably perforated across the width and at predetermined locations along the length of the material by a perforator 56. Additionally, notches 71–76 (FIG. 9) may be cut in the protective material 46 by a trimming knife 58. The notches 71–76 are cut at predetermined locations to assist the hairdresser in folding the protective cover. Notches 71–76 allow the hairdresser to form a plurality of panels 63–68 (see FIG. 10) that assist in folding the protective cover **46*a* so that it conforms to the scalp of the person undergoing hair treatment. Alternatively, pre-printed indicia may be substituted for notches 71–76** to assist the hairdresser in cutting or folding the protective cover into a particular configuration.

Once the protective cover material 42 has been prepared as described above, it may be rolled into a roll 60 used for dispensing individual segments of the protective cover material 42.

Figure 9:
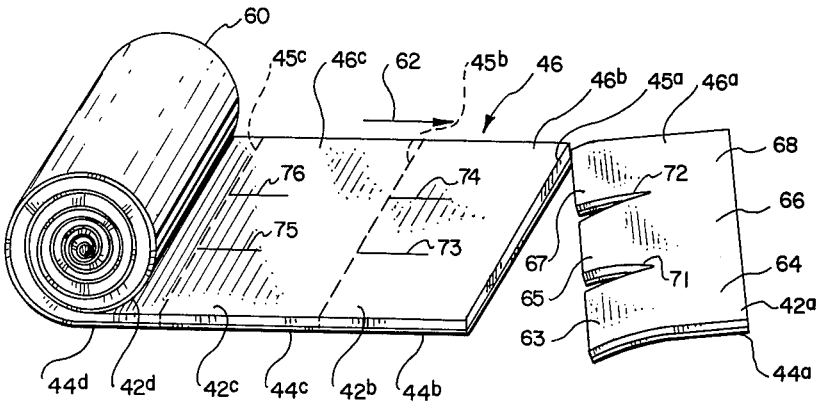
FIG. 9 is a perspective view of the protective cover illustrating one method for supplying the protective covers as a continuous roll.
Figure 10:
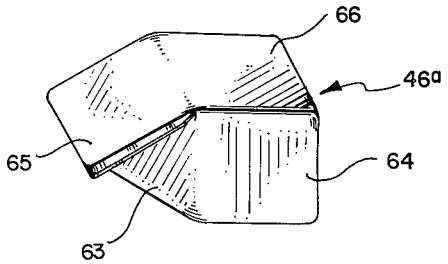
FIG. 10 is an enlarged, schematic perspective view of a procedure for folding the protective cover shown in FIGS. 8 and 9.

Referring now more particularly to FIG. 9, roll 60 is shown in the configuration which would be available to a professional hairdresser. In particular, roll 60 is unrolled as indicated by direction arrow 62 to expose a plurality of protective cover segments **46*a*–46*c*. Protective cover segments 46*a*–46*c* are defined by the perforations 45*a*–45*c*, which perforations have been produced by perforator 56 (FIG. 8). Protective cover 46*a* is shown in the process of being partially severed from the roll 60 by tearing along the perforation formed at perforation 45*a*. Although perforations 45*a*–45*c* have been described in the illustrated embodiment, they may be dispensed with entirely, allowing the hairdresser to simply cut each segment from roll 60** according to individual preferences.

Figure 11:
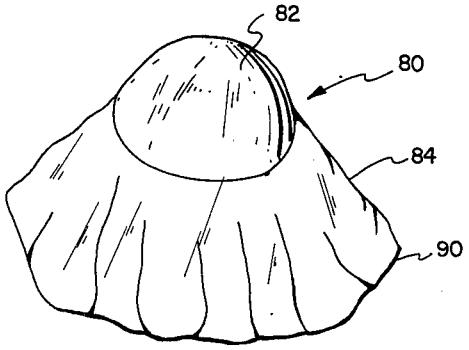
FIG. 11 is a perspective view of another preferred embodiment of the protective cover of the present invention wherein the cap of synthetic sponge material is preformed with a generally shell-like configuration and the liquid-impervious liner forms a skirt extending beyond the periphery of the cap.

Referring now to FIG. 11, protective cover 80 is shown with the synthetic sponge-like material 82 formed into a cap 82 having a shell-like shape. The liquid-impervious liner 84 interiorily lines cap 82 and also extends downwardly from the periphery of cap 82 to form skirt 90.

Figure 12:
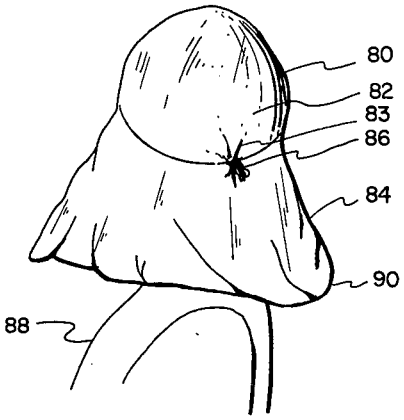
FIG. 12 is a perspective view of the protective cover of FIG. 11 as initially fitted to the scalp of a customer.
Figure 13:
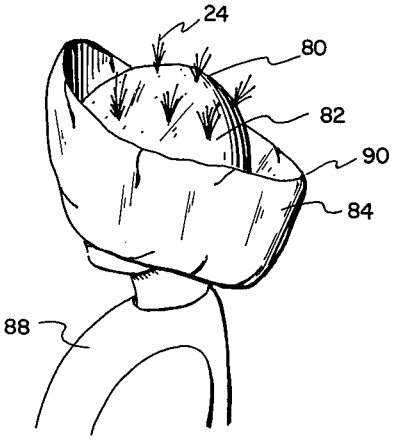
FIG. 13 is a perspective view of the protective cover of FIGS. 11 and 12 with the skirt partially folded over the cap.
Figure 14:
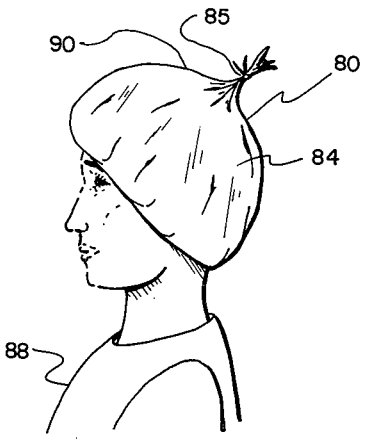
FIG. 14 is a perspective view of the protective cover of FIGS. 11, 12 and 13 with the skirt completely enclosing the cap and with the periphery of the skirt tied off to sealingly enclose the treated hair.

With reference to FIGS. 12–14, protective cover 80 is shown on a patron 88 with the synthetic sponge-like cap 82 adjusted to fit the scalp of patron 88. Advantageously, cap 82 and skirt 84 are sufficiently flexible to permit clipping or otherwise tying cap 82 at tie 86, thereby readily adjusting cap 82 so that it comfortably fits the particular head size of patron 88.

Skirt 84 is constructed so that it extends approximately 14–16 inches beyond the periphery of cap 82. This allows the skirt 84 to be drawn over the hair when the chemical treatment is accomplished (see FIGS. 14–15). Skirt 84 thereby encloses the treated hair and is tied at 85. Thereafter, the hairdresser completes the treatment by subjecting the chemically treated, encapsulated hair to a heat treatment process. Since the hair is encapsulated by skirt 84 and the corresponding liquid-impervious liner to cap 82, it has been found that the processing time can be reduced to approximately one-half the time, even at a medium to low heat setting.

From the foregoing, it will be appreciated that the present invention provides numerous advantages. The protective cover of the present invention is substantially neater in appearance than the prior art rubber cap, which is usually stained and unpleasant smelling. The protective cover of the present invention also may be adjusted to comfortably fit the head of the patron. Other advantages include the speed of application of hair coloring chemicals and processing, greater variety in available coloring patterns that may be developed, and disposal after a single use.

The invention may be embodied in other specific forms without departing from its spirit or essential characteristics. The described embodiments are to be considered in all respects only as illustrative and not restrictive and the scope of the invention is, therefore, indicated by the appended claims rather than by the foregoing description. All changes that come within the meaning and range of equivalency of the claims are to be embraced within their scope.

What is claimed and desired to be secured by a United States Letters Patent is:

1. A protective cover for use in dyeing selected locks of hair of a patron while shielding the remaining portion of hair from the liquid dye applied to said locks of hair, said protective cover comprising:

an outer layer fabricated from material adapted to absorb excess liquid dye that may be applied to said locks of hair;

a liquid impervious liner adapter to be placed adjacent the scalp of a patron, said liner and outer layer being fabricated from materials that are easily punctured to permit withdrawal of said locks of hair through the points of puncture, and said liner and outer layers being joined together and supplied as an essentially flat piece of material that may be folded or cut to fit the scalp of a patron;

adhesive tabs for securing the folds of said protective cover once it has been folded to fit the scalp of a patron; and pre-printed indicia placed on said protective cover as a guide to folding or cutting the cover.

2. A protective cover as defined in claim 1 wherein said protective cover is perforated along at least a portion of said pre-printed indicia.

3. A protective cover as defined in claim 1 wherein the protective cover is fabricated as a part of a continuous roll of individual protective covers.

4. A protective cover as defined in claim 1 wherein said liquid-impervious liner comprises a sheet of plastic.

5. A protective cover as defined in claim 1 wherein said liner comprises a thin liquid-impervious surface layer bonded to one side of said outer layer.

6. A protective cover as defined in claim 1 wherein said liner further comprises a skirt member that extends sufficiently from the periphery of the outer layer as to permit said skirt member to be folded over the top of the patron's head, thereby enclosing the treated locks of hair within the folded skirt member.

7. A protective cover for use in dyeing selected locks of hair while shielding the remaining portions of hair from the liquid dye applied to said locks of hair, said protective cover comprising:

a cap member fabricated from material adapted to absorb excess liquid dye that may be applied to said locks of hair, said cap member being formed in a shell-like configuration so as to loosely fit over the scalp of a patron;

a liquid-impervious liner inside said cap member, the material of said liner and cap member being easily punctured to permit withdrawal of said locks of hair through the points of puncture, and said liner further comprising a skirt that extends sufficiently beyond the periphery of said cap member as to permit said skirt to be folded over the top of the cap member, thereby enclosing the dyed locks of hair and the cap member within the folded skirt, whereby the necessary treatment time for the hair is reduced; and means for adjusting the fit of said cap member and liner so that they conform to the scalp of a patron.

8. A protective cover as defined in claim 7 wherein the material forming the cap member is synthetic sponge.

9. A protective cover as defined in claim 7 wherein the liquid-impervious liner is plastic.

10. A protective cover as defined in claim 7 wherein the liquid-impervious liner is attached to said cap member about the periphery of the cap member.

11. A protective cover as defined in claim 10 wherein the liquid-impervious liner is further attached to said cap member interiorly of the periphery of the cap member.

12. A protective cover as defined in claim 7 wherein the means for adjusting the fit of said cap member and liner is a tie string extending about the periphery of the cap member.

13. A protective cover as defined in claim 12 wherein the tie string is secured to portions of the periphery of the cap member so that the fit of the cap is adjusted by drawing such secured portions toward one another.

14. A method of dyeing selected locks of hair on the scalp of a patron while shielding the remaining portions of hair from the liquid dye applied to said locks of hair, the method comprising the steps of:

obtaining a protective cover having a shell-like cap formed from a liquid absorbing material and a liquid-impervious liner inside said cap, the liner having a skirt member extending beyond the periphery of said cap;

placing the cap on the head of a patron such that said liner is adjacent to the patron's scalp;

adjusting the fit of said protective cover so that said cap and liner conform to the scalp of the patron;

puncturing said cap and liner at selected locations;

withdrawing a lock of hair through said liner and cap at each point of puncture;

applying dye to the withdrawn locks of hair;

folding the skirt member of said liner up over the top of said cap and said dyed locks of hair;

securing said folded skirt member so as to enclose therein said dyed locks of hair; and heat treating said dyed locks of hair.

15. A method of dyeing selected locks of hair on the scalp of a patron while shielding the remaining portions of hair from the liquid dye applied to said locks of hair, the method comprising the steps of:

obtaining a generally flat protective cover having a first surface fabricated from liquid absorbent material and a second surface fabricated from liquid-impervious material;

folding said protective cover along pre-printed lines so that it will conform to the scalp of said patron with the liquid impervious material adjacent the scalp;

securing the folded protective cover with adhesive tabs.

puncuring said first and second surfaces of the protective cover at selected locations;

withdrawing a lock of hair through said protective cover at each point of puncture; and applying dye to said locks of hair.

16. A method as defined in claim 15 wherein said folding step is preceded by the step of cutting said flat piece of protective cover along pre-printed indicia placed on said protective cover.

17. A method as defined in claim 15 wherein said liquid-impervious material comprises a skirt member and wherein said method further comprises the steps of:

pulling said skirt member down over the head of said patron while adjusting the fit of said protective cover; and folding said skirt member over the top of said protective cover after the locks of hair have been dyed, thereby enclosing the treated locks of hair within said folded skirt member.

* * * * *